United States Patent [19]

Centanne

[11] Patent Number: 4,664,226

[45] Date of Patent: May 12, 1987

[54] ESCAPE SYSTEM

[76] Inventor: Michael Centanne, 4326 W. Lawrence, Chicago, Ill. 60630

[21] Appl. No.: 765,522

[22] Filed: Aug. 14, 1985

[51] Int. Cl.[4] ..... A62B 1/02; B66B 9/02

[52] U.S. Cl. ..... 182/82; 182/141; 187/6

[58] Field of Search ..... 182/82, 141, 148, 145; 187/6

[56] References Cited

U.S. PATENT DOCUMENTS

| | | | |
|---|---|---|---|
| 308,444 | 11/1884 | Terwilliger | 182/143 |
| 802,252 | 10/1905 | Anderson | 182/36 |
| 807,161 | 12/1905 | Foulks | 49/379 |
| 1,831,711 | 11/1931 | Keen | 105/82 |
| 2,647,675 | 8/1953 | Bernett | 182/82 |
| 3,016,989 | 1/1962 | Lindmark | 182/82 |
| 3,256,956 | 6/1966 | Puhringer | 182/141 |
| 3,944,021 | 3/1976 | Smith | 182/36 |
| 4,350,224 | 9/1982 | Jochum | 182/82 |
| 4,406,349 | 9/1983 | Vilchek | 182/82 |
| 4,433,752 | 2/1984 | Cunter | 182/82 |
| 4,467,889 | 8/1984 | Maubach | 182/82 |
| 4,469,198 | 9/1984 | Crump | 187/6 |

*Primary Examiner*—Reinaldo P. Machado

[57] ABSTRACT

An escape system for buildings which is comprised of at least one vertically disposed runner positioned preferably on the exterior of a building adapted to engage and support a removable power driven platform carriage which moves from floor to floor receiving trapped persons and delivering the same to safety levels. The driving power can be mechanical, electrical, manual, or combinations of thereof.

3 Claims, 7 Drawing Figures

ESCAPE SYSTEM

BACKGROUND OF THE INVENTION

1. Field of the Invention

The present invention relates to an escape system for a building and especially one of the high rise variety.

2. Description of the Prior Art

The prior art is aware of various escape systems associated with buildings for assisting residents thereof from the upper floors in case of unforeseen emergencies and especially fires.

Generally, the following patents typify the known systems.

U.S. Pat. No. 308,444
U.S. Pat. No. 802,252
U.S. Pat. No. 807,161
U.S. Pat. No. 1,831,711
U.S. Pat. No. 3,944,021

From a review of these patents, it is apparent that the problem has confronted poeple for years and is an ongoing matter with different solutions for the same.

Basically, these patents, as well as the present invention, relate to mounting a rail or an equivalent support on the face of the building and utilizes the same to guide a person therealong from an upper level to a lower safety level.

SUMMARY OF THE INVENTION

The present invention while generally falling in the same category as the known escape systems provides various refinements to the same which makes it more economical to fabricate and install, provides a simple, easily controlled driven carriage which provide additional protection to the users of the same, and is designed so as not to detract from the overall appearance of the building on which it is installed.

Briefly, the invention includes the mounting of guide rails over one or several faces of the building with a carriage and drive therefor which is readily installed and removed from the rail for use and non-use conditions.

DESCRIPTION OF THE PREFERRED EMBODIMENT

Figure 1:
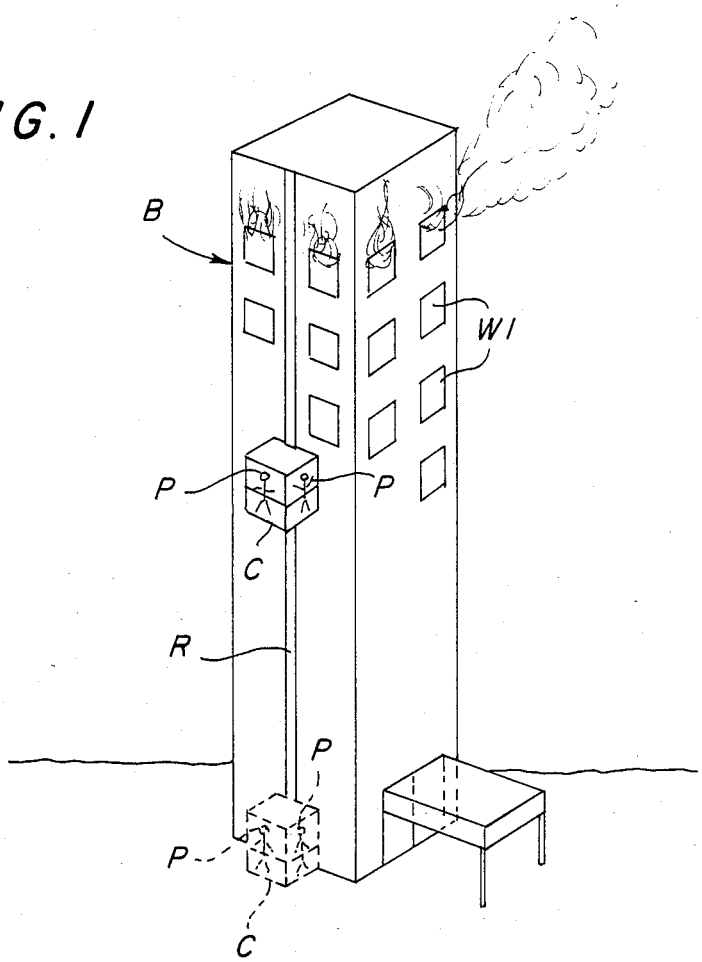
FIG. 1 is a perspective view of the escape system associated with a building.

The escape system of the present invention is seen in FIG. 1 as being used in conjunction with a building B and includes a vertical rail R positioned thereon by any suitable means having a power driven platform carriage C movably mounted thereon. In use, the carriage C can be driven from one floor to another to receive people P escaping from windows WI avoiding a disastrous situation within the building B and moving them to a safety level as shown in dotted line C of the carriage which has moved adjacent ground level to discharge the people P.

Figure 3:
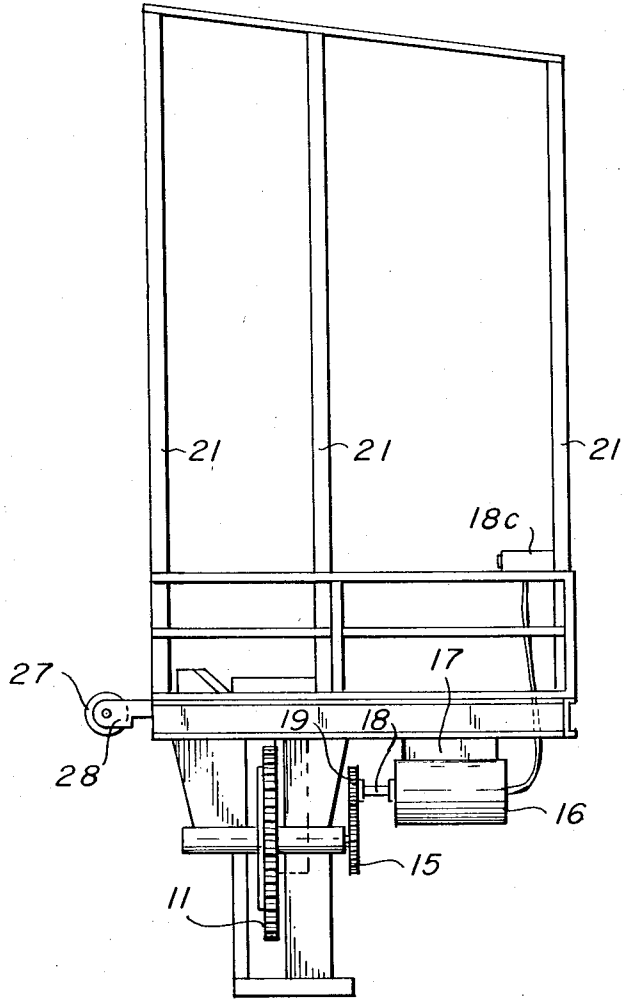
FIG. 3 is a side view of the carriage shown in FIG. 2 illustrating further details of the drive.
Figure 2:
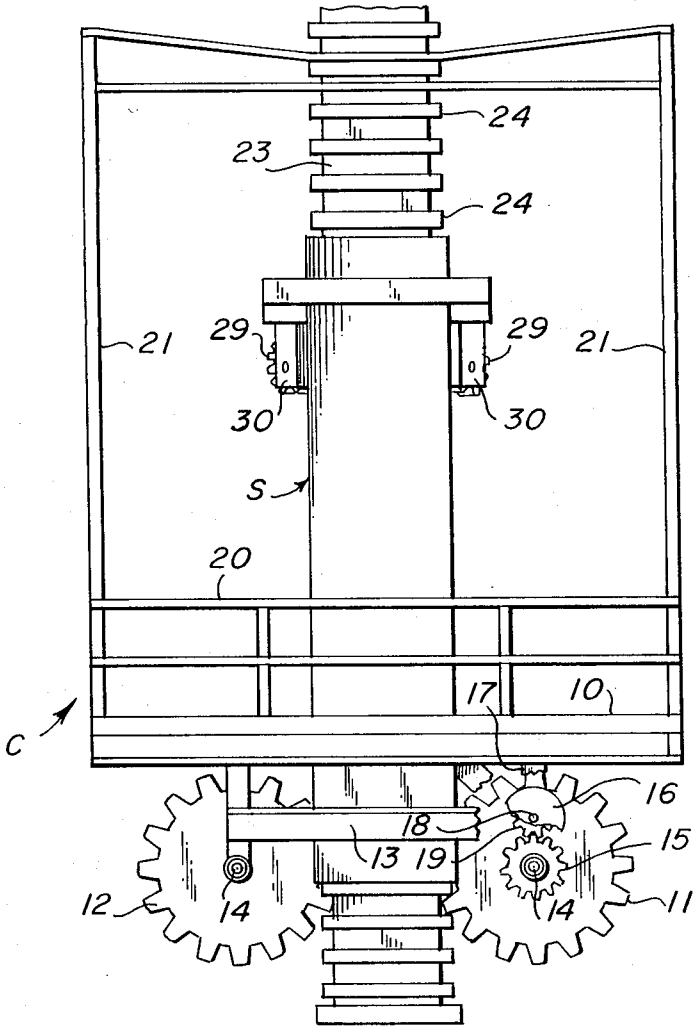
FIG. 2 is a front view of the carriage showing some of the drive components thereof.
Figure 4:
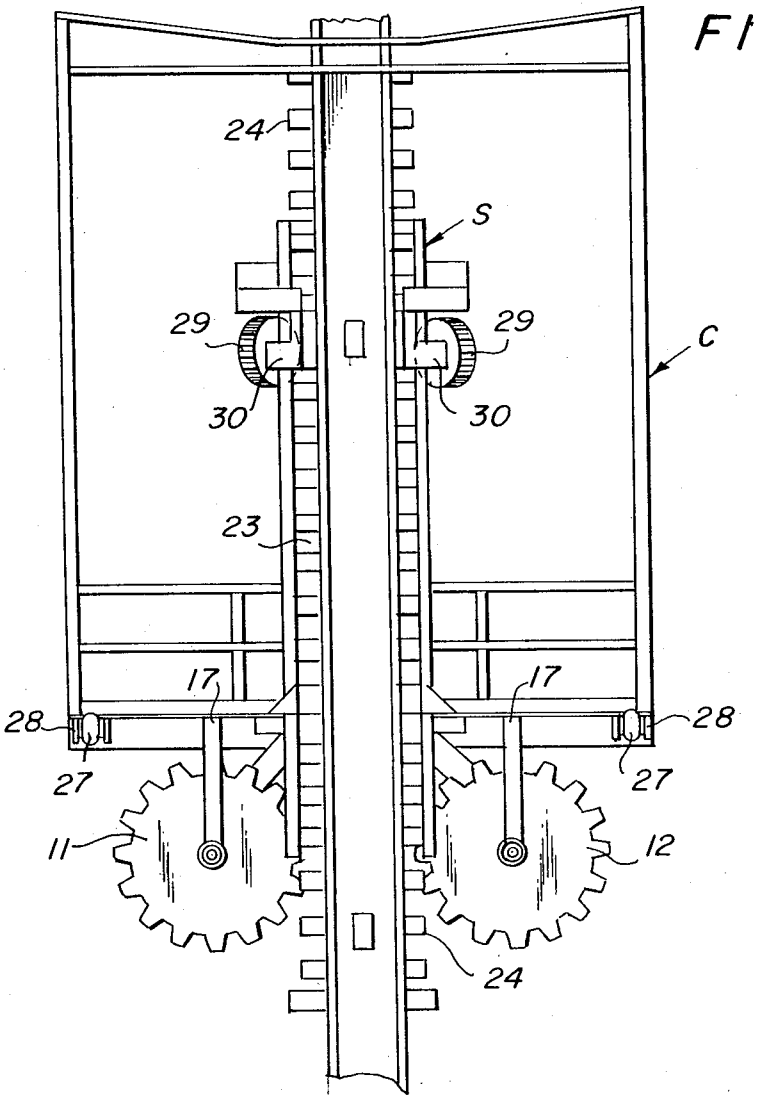
FIG. 4 is a rear view of the carriage of FIGS. 2 and 3 showing additional support rollers.

With reference to FIGS. 2, 3 and 4, the carriage C is seen to be comprised of a tubular sleeve S having a platform 10 secured to and disposed therearound to form a unitized structure. The underside of the platform is provided with interconnected angle irons 13 which can assume any configuration as long as the same is strong enough to support a pair of oppositely disposed gears 11,12 which are rotatably disposed on shafts 14,14. As seen in FIG. 3, one of the shafts 14 has a gear 15 fixed adjacent the end thereof. As further seen, a reversible drive motor 16 is suspended from the underside of the platform 10 by a bracket 17 and has a driven shaft 18 with a gear 19 thereon meshing with gear 15 to impart rotation to the same for driving the gear 11 in either of two directions for moving the carriage C upwardly or downwardly.

With continuing reference to these Figures, the carriage C is provided with a safety rail 20 mounted about the peripheral edge of the platform 10 and optional vertical supports 21 located at the corners 18 thereof to permit the enclosing of the platform with panels, cloth or the like.

Figure 6:
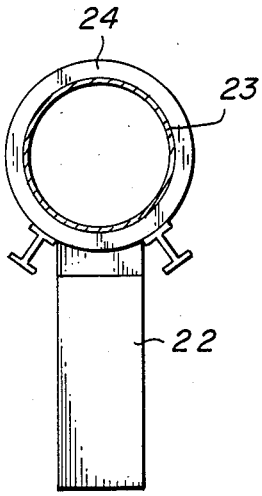
FIGS. 6 and 7 are sectional views of further details of the rack of FIG. 5.
Figure 7:
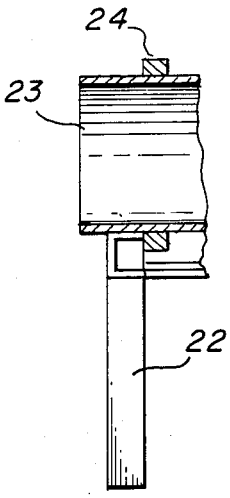
Figure 5:
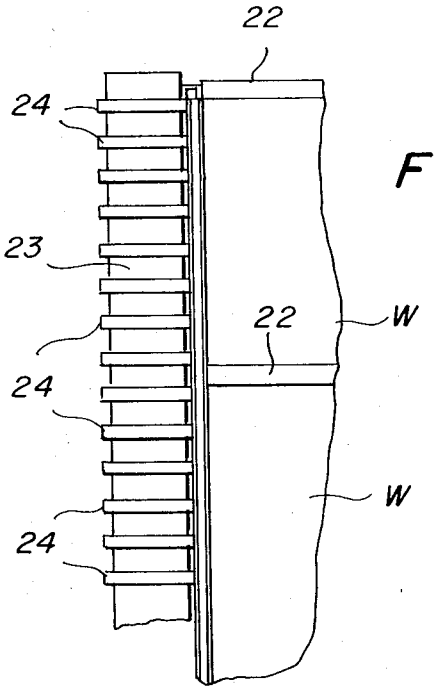
FIG 5 is a detailed view of the drive rack and its mounting with respect to the building.

As mentioned previously, the carriage C cooperates with the rail R for movement over the face of the building, and as seen in FIGS. 5 and 6, the rail R is comprised of an elongated member 23 which can be circular or rectangular in cross section having a plurality of spaced teeth 24,24 disposed over the length thereof. The rear face of the member 23 has a pair of inwardly directed channel members CM secured thereto. A plurality of spaced struts 22,22 secure the member 23 to the building wall.

Referring back to FIG. 4, the tubular sleeve S is slotted at 25 to reduce the overall weight of the carriage and to facilitate the mounting of the carriage onto the member 23. Additionally, the sleeve S is slit at 26 adjacent the gears 11,12 beneath the platform to permit a portion 18 of the gears 11,12 to extend therein to engage the teeth 24 whereby when the motor 16 is energized the gear 11 will be driven to impart motion to the carriage by engagement with the teeth 24. As is apparent, the carriage C moves upwardly or downwardly in response to the rotational direction of motor shaft 18. The motor has controls 18C which can be located on the carriage or at ground level for actuating the same.

To insure stability to the carriage C in its movement over the wall W, the same is provided with steadying rollers 27 supported in brackets 28 mounted on the underside corners of the platform 10 which engage the wall W in its movement thereover. Additionally, the sleeve S is provided with inwardly directed rotatable gears 29,29 positioned on brackets 30,30 adjacent the slot 25 to constrain the sleeve S on the tubular member 23,24. Each of the gears 29,29 ride in the channel members CM. When the motor is stopped, the meshing of the gears 11, 12 with the teeth 24 serve to lock the carriage in place. The carriage is also provided with conventional elevator brake means, not shown, which are actuated upon power failure.

Other variations can extend to the power source used to drive the carriage, and the use of air, mechanical means, or a combination thereof along with the electrical drive are considered equivalents to that as disclosed.

In normal use, the carriage C is stored adjacent the building or can be carried by the fire engine, so that in an emergency situation, the sleeve S is slipped onto the member 23 with the gears 11, 12 thereof in mesh with the teeth 24. Thereafter, the motor controls 18C are actuated to drive the motor and in turn the gears to propel the carriage over the face thereof stopping to receive guests escaping from the building. Thereafter, they are delivered to a safety level for escape.

I claim:

1. An escape system for a building comprised of a rail secured to a wall thereof and extending the substantial length thereof, said rail being secured to said wall by a plurality of spaced struts extending over the length thereof, said rail having a plurality of teeth spaced over the length of the same, a carriage adapted to be removably secured thereto, said carriage includes a platform and a sleeve extending therefrom, said sleeve being of the same general shape as said rail and is open on one side to permit the same to be positioned and removed from said rail, gear means supported on said platform and being positioned to engage said teeth when the sleeve is in engagement with said rail, said gear means being supported on the underside of said platform and the sleeve being provided with slots adjacent said rail permitting the gear teeth to extend therein into engagement with said spaced teeth of said rail, reversible drive means connected to said gear means for driving the same to impart motion to said carriage, said reversible drive means being mounted on said platform and being connected to said gear means for imparting rotation thereto, and wherein the rail has a pair of inwardly extending channel members secured thereto outwardly of said supporting struts and the sleeve has a second pair of gears thereon with one of each riding in said channel members to constrain the same thereon.

2. The escape system of claim 1 wherein remote control means are provided on the carriage for energizing the motor.

3. The escape system of claim 1 wherein the platform is provided with guard rails about the periphery thereof.

* * * * *